US009938044B2

(12) United States Patent
Gamboa

(10) Patent No.: US 9,938,044 B2
(45) Date of Patent: Apr. 10, 2018

(54) VERTICAL AND HORIZONTAL SIMULTANEOUSLY AND SELECTIVELY EXPANDABLE STRUCTURE

(71) Applicant: Jose Gamboa, Paterson, NJ (US)

(72) Inventor: Jose Gamboa, Paterson, NJ (US)

( * ) Notice: Subject to any disclaimer, the term of this patent is extended or adjusted under 35 U.S.C. 154(b) by 0 days.

(21) Appl. No.: 15/635,218

(22) Filed: Jun. 28, 2017

(65) Prior Publication Data

US 2017/0297768 A1 Oct. 19, 2017

(51) Int. Cl.

| | |
|---|---|
| ***B65D 21/08*** | (2006.01) |
| ***B65D 88/00*** | (2006.01) |
| ***B65D 85/68*** | (2006.01) |
| ***F24F 13/32*** | (2006.01) |

(52) U.S. Cl.

CPC ..... *B65D 21/086* (2013.01); *B65D 85/68* (2013.01); *B65D 88/005* (2013.01); *F24F 13/32* (2013.01); *B65D 2585/6812* (2013.01); *F24F 2221/20* (2013.01)

(58) Field of Classification Search

CPC ..... B65D 21/086; B65D 2585/6812; B65D 88/05; B65D 88/005; B65D 21/08; B65D 7/14; B65D 7/20; B65D 7/24; F24F 13/32; F24F 2221/20

USPC ..... 220/8, 666

See application file for complete search history.

(56) References Cited

U.S. PATENT DOCUMENTS

| | | | | |
|---|---|---|---|---|
| 844,955 A | | 2/1907 | Robert | |
| 908,170 A | * | 12/1908 | Van der Boom | A47G 1/08 273/157 R |
| 1,212,948 A | | 1/1917 | Albert | |
| 2,223,074 A | | 11/1940 | Martin | |
| 3,227,015 A | | 1/1966 | Tremblay | |
| 3,934,770 A | * | 1/1976 | Larsen | B62J 9/00 211/132.1 |
| 4,079,813 A | * | 3/1978 | Ellison | A47L 3/02 182/62 |
| 5,054,426 A | | 10/1991 | Panarelli et al. | |
| 5,469,807 A | * | 11/1995 | Kosmaczeska | A01K 1/033 119/484 |
| 6,382,435 B1 | * | 5/2002 | Legaz | B62B 3/006 211/149 |
| 6,470,829 B1 | | 10/2002 | Spangler et al. | |
| 7,823,739 B2 | | 11/2010 | Sadkin et al. | |
| 8,827,095 B1 | | 9/2014 | Sackett | |
| 2005/0145192 A1 | | 7/2005 | Axelrod et al. | |
| 2010/0074723 A1 | | 3/2010 | Lancon | |
| 2011/0297675 A1 | | 12/2011 | Johnson et al. | |
| 2014/0246425 A1 | | 9/2014 | Janin | |

* cited by examiner

*Primary Examiner* — Stephen Castellano
(74) *Attorney, Agent, or Firm* — Michael J. Feigin, Esq.; Feigin & Fridman LLC

(57) ABSTRACT

A box which is expandable vertically and horizontally is disclosed. The box can be expanded both vertically and horizontally simultaneously, or in only one of these directions. This is accomplished by pulling/pushing opposite sides further/closer to each other. Rails which at least partially extend between respective opposite sides allow such an expansion/or contraction, the rails, in embodiments, having a pin of one section of the box held within a slot of an adjacent section of the box. The box, in embodiments, is made up of four separate pieces, each being one quadrant (top & left, top & right, bottom & left, bottom & right) of the box. Such a box can be expanded/collapsed to fit within a window and hold an air conditioner there-in.

19 Claims, 8 Drawing Sheets

VERTICAL AND HORIZONTAL SIMULTANEOUSLY AND SELECTIVELY EXPANDABLE STRUCTURE

FIELD OF THE DISCLOSED TECHNOLOGY

The disclosed technology relates generally to boxes, and more specifically to expandable and collapsible boxes.

BACKGROUND

Collapsible or telescopic containers (Cooperative Patent Classification (CPC) B65D21/086) are, of course, known in the art. However, these containers often require one to add or remove or disconnect components in order to change the size. Or, the size can be changed in only one Euclidean vector direction (e.g. increase the height vertically or horizontally, but not both).

U.S. Patent Publication 2010/0074723 to Lancon, for example, discloses a collapsing cargo box. The box has a top container and bottom container which fit over each other. The top container telescopes outward using a rail system to be above the bottom container. This reference discloses the concept of vertical rails which are expanded to enlarge the box in one direction only. U.S. Pat. No. 2,223,074 to Martin discloses a window box which is hung from a window. The box slides against itself to make the box wider or narrower. This reference shows the concept of horizontally widening a box only. This is accomplished by pulling it apart. U.S. Pat. No. 7,823,739 to Sadkin et al. discloses a collapsible shipping container with bi-folding sidewalls which collapse in accordion style. In this manner, the box can be expanded and lowered in height.

What is needed in the art is way to improve upon the prior technology and make it more versatile as well as easier to use. For example, while the Martin box can be expanded in one direction to fill in a window, if one's window is a different height, the Martin box will not be sufficient. One would need to procure an entirely separate box, adding to costs of production, warehousing, shipping, and so forth since so many different size boxes are needed. If a "one size fits all" box could be made to fit any shape space, this would be preferable.

SUMMARY OF THE DISCLOSED TECHNOLOGY

A box which is independently expandable in both a horizontal and vertical direction while retaining a rigid structure (at least each outer wall is unbendable/unbent) in embodiments of the disclosed technology, is made up of four different distinct and individual pieces. Each form a quadrant of the box and slides to connect to two other pieces which are the two pieces in adjacent quadrants. Each piece further forms at least a part of two walls of the box which are perpendicular to each other.

The pieces can be slid into place by way of a pin extending through a slot to connect them. If one pulls two sections away from each other or pushes two sections closer to each other, then the pin and slot move with respect to one another accordingly. The pin and slot are on adjacent pieces such that pulling or pushing them moves two of the four pieces toward or away from each other, expanding the box in the horizontal or vertical direction. Further, the horizontal and vertical movement are uncoupled from each other so that one can expand in either direction without expanding in the other, or expand partially in one direction and partially in another, and so forth in any combination of no expansion, partial expansion, or full expansion. No expansion, or a collapsed state is defined as one in which two pieces (quadrants) are pushed as close together as possible (without causing damage). In such an embodiment, the respective pin and slot cannot be pushed further as the pin abuts an end of the slot at a side of the slot which is furthest away from an opposite side of the piece with the respective pin. A partial expansion is where a pin is between two extreme ends of a respective slot, or where two pieces (quadrants) can be pulled apart further or pushed together further. A full expansion is the opposite of a collapsed state where two pieces (quadrants) are pulled apart from each other as much as possible and a pin is against a side of the slot which is closed to an opposite side of the piece with the pin.

In some embodiments, the box is at least partially closed on five sides and open on a sixth side, the sixth side being surrounded by front panels which extend past each horizontal-most extent of at least a left wall and right wall of the box. The left wall has a portion of two of the four separate pieces and the right wall has a portion of two (other) of the four separate pieces. The front panels can be placed or positioned inside a window and a majority of the left wall and the right wall are outside of the window. So too, a majority of the box can be outside the window and box walls can fill a space of the window, which for purposes of this disclosure, is any rectangular or substantially rectangular space within a larger surface.

The front panels can form a closed rectangle when the box is fully collapsed ("fully" meaning both vertically and horizontally). This rectangular space can open into the box without interruption (no other part of the box structure or box itself is in the opening). This rectangular space can be substantially the size of an opening in a window where the box is mounted. When the box is expanded, at least partially in the horizontal and the vertical direction, the rectangular space is increased in size both in the x and y direction through the front panels each becoming spaced apart from one another.

In more detail, the four pieces, in embodiments of the disclosed technology, are a first piece, a second piece, a third piece, and a fourth piece. The first piece is connected to the second and third. The second, to the first and fourth. The third, to the first and third. The fourth, to the second and fourth. The first piece forms a part of a top side and left side. The second forms a part of the top side and right side. The third forms a part of the left side and bottom side. The fourth forms a part of the right side and bottom side. The cardinal directions (top, bottom, left, right, etc.) are relative to each other and their arrangement within the box.

In the above embodiment, the first piece and fourth piece are without connection to one another, and the second piece and the third piece are without connection to one other. A back side is formed from a part of each of the four pieces, in embodiments, and each of the four pieces can have a diagonal cross bar, which is diagonal with respect to the most elongated sides of the sides, top and bottom. This diagonal cross bar closes a part of the back side when used.

When in a collapsed configuration or condition, the collapsed side (the top side, left side, right side, and/or bottom side) is of double thickness compared to when (fully) expanded.

Another way of describing the box of embodiments of the disclosed technology is by way of the arrangement of connectors between the sides. A first side of the box has a pair of horizontally extending rails and a pair of vertically extending rails. A second side, opposite the first side, has an additional pair of horizontally extending rails and an additional pair of vertically extending rails. Each of these rails further has at least one pin passing through a slot such that the at least one pin and the slot are movable in one plane to expand or contract the box in such a respective plane.

One or more pins can be fixed to a side of the box. Each pair of rails has, in embodiments of the disclosed technology, a first rail and a second rail on an opposite side of the box from each other. Each rail slides (is slidable, that is, capable of being slid) with respect to each pin such that the box is expandable in a first of a vertical or horizontal direction without expanding in a second of a vertical or horizontal direction. Or, one can expand the box in both the vertical and the horizontal direction simultaneously (defined as "in one motion" or "such that there is expansion in both directions at the same time").

The box can be sized to fit within an opening of a window. When it is, a portion of the box can be placed interior to the window and abutted against the window by front panels which define (surround) an opening into the box. Such an opening is transverse to both the vertical and the horizontal direction of expansion, described previously. These front panels can be on a side of one of the pairs of horizontally extending rails and one of the pairs of vertically extending rails. Each other side of the box, other than a side with the opening into the box, is at least partially closed by walls which extend between at least two rails of one the collective group of rails afore-described (the horizontally and the vertically extending rails).

Any device or step to a method described in this disclosure can comprise or consist of that which it is a part of, or the parts which make up the device or step. The term "and/or" is inclusive of the items which it joins linguistically and each item by itself. "Substantially" and "generally" is defined as "at least 95% of the term being described" and any device or aspect of a device or method described herein can be read as "comprising" or "consisting" thereof.

DETAILED DESCRIPTION OF EMBODIMENTS OF THE DISCLOSED TECHNOLOGY

A box which is expandable vertically and horizontally is disclosed. The box can be expanded both vertically and horizontally simultaneously, or in only one of these directions. This is accomplished by pulling/pushing opposite sides further/closer to each other. Rails which at least partially extend between respective opposite sides allow such an expansion/or contraction, the rails, in embodiments, having a pin of one section of the box held within a slot of an adjacent section of the box. The box, in embodiments, is made up of four separate pieces, each being one quadrant (top & left, top & right, bottom & left, bottom & right) of the box. Such a box can be expanded/collapsed to fit within a window and hold an air conditioner therein.

Embodiments of the disclosed technology will become clearer in view of the following description of the figures.

Figure 2:
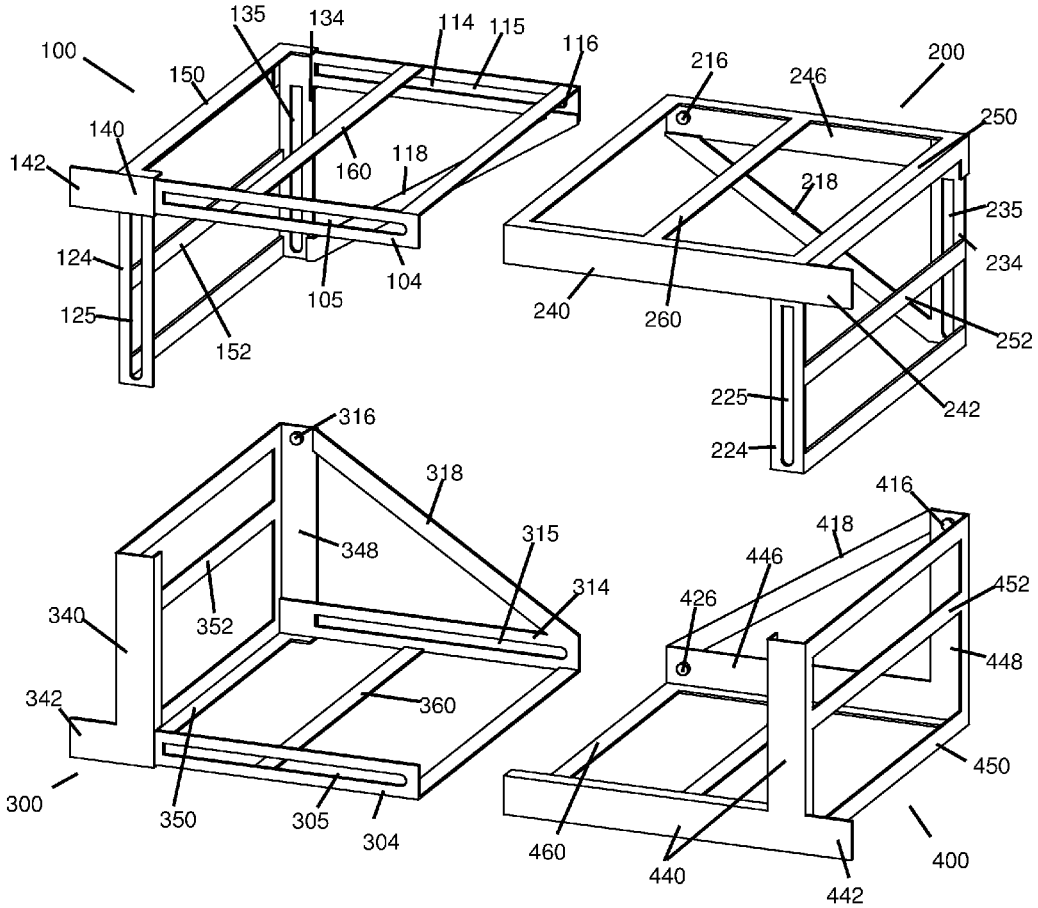
FIG. 2 shows an exploded front perspective view of four sections of the expandable box of an embodiment of the disclosed technology.

Starting with FIG. 2, FIG. 2 shows an exploded front perspective view of four sections of the expandable box of an embodiment of the disclosed technology. In this view, the expandable box has been divided into four quadrants or it's four component pieces used in embodiments of the disclosed technology. Each is slidably connected to another by way of a male connector (e.g. pin) and female connector (rail). While one arrangement of rails and pins are shown, it should be understood that any variant embodiment which slidably connects together four quadrants is within the scope of the disclosed technology. Thus, for example, the position of respective rails and pins can be modified, such as by reversing the position of one of the rails with one of the pins or by using more than one pin or a series of pins adapted for placement within a rail.

Now referring specifically to the embodiment shown in FIG. 2, there are four pieces 100, 200, 300, and 400, as shown. Each piece has fixed sub-pieces which move in tandem with each other and/or are fixed to each other. In embodiments of the disclosed technology, the box is procured from solid, non-pliable materials. Piece 100 is adjacent to, and connects with, piece 200 and 300. Piece 200 is adjacent to, and connects with, piece 100 and 300. Piece 300 is adjacent to, and connects with, piece 100 and 400. Piece 400 is adjacent to, and connects with, piece 200 and 300. As such, pieces which are diagonal to each other are unconnected to each other and move independently of one another. However, adjacent pieces can move toward/away from each other only (and in turn, therefore, diagonal pieces can move diagonally away from each other through a combination of movement of respective adjacent pieces). In this manner, one can increase the size of a box vertically or horizontally or both simultaneously.

With the exception of the front portions 140, 142, 240, 340, 342, and 440, the pieces can be substantially identical or fully identical, within a tolerance level acceptable in the industry. Each has at least one rail 104, 114, 224, 234, 304, 314 and/or at least one pin 216, 316, 416, and 426. Within each rail is a slot 105, 115, 225, 235, 305, and 315. Each pin slides within each rail. That is, a rail and respective pin are movable with respect to each other such that pin can move between extreme ends of each slot. Thus, for example, rail 234 has a slot 235 in which pin 416 can move. Assuming the bottom of the sheet where FIG. 2 is drawn in the bottom of the box, then when piece 200 moves upward (meaning, piece 100 also moves upward) the pin 416 becomes lower within the slot 235 as the slot 235 moves upward. This same arrangement takes place as each of the respective pieces moves with respect to another.

In this manner, the box can be expanded vertically by moving pieces 100 and 200 upward with respect to pieces 300 and 400, or horizontally by moving pieces 100 and 300 away from pieces 200 and 400. When this is done, the rails move past the pins such that the pins become closer to an end of a respective slot which is closest to the piece which is moving away. As the vertical and horizontal movement are independent from each other, each can be done without affecting the other degree of movement.

Figure 3A:
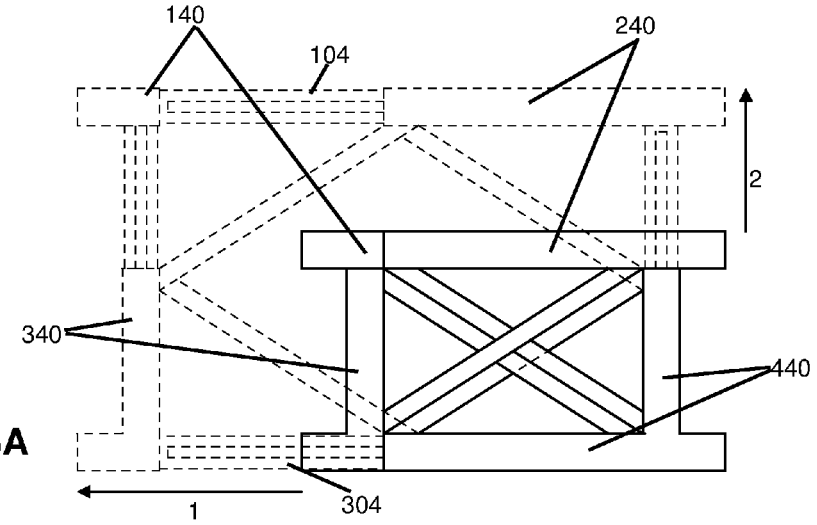
FIG. 3A shows how the expandable box of embodiments of the disclosed technology expands simultaneously both horizontally and vertically.
Figure 3B:
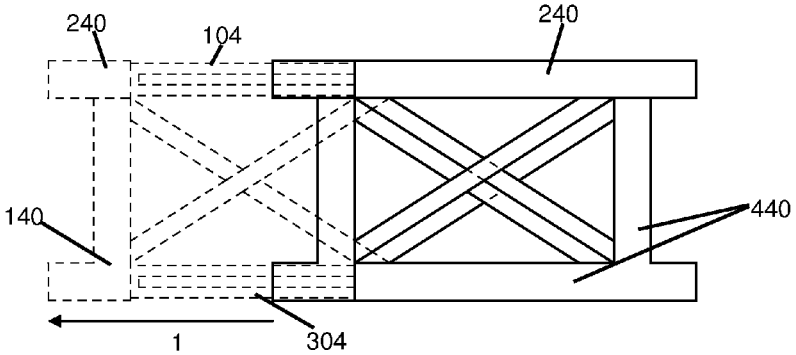
FIG. 3B shows how the expandable box of embodiments of the disclosed technology expands horizontally.
Figure 3C:
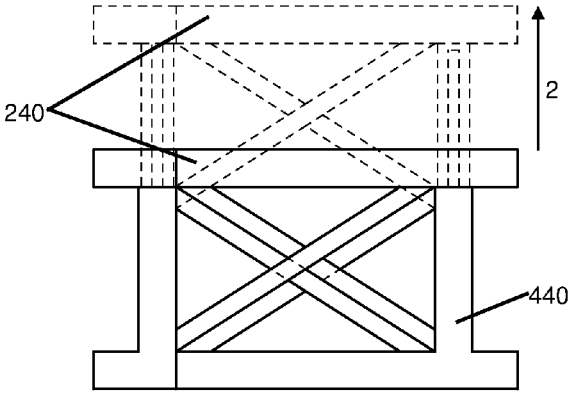
FIG. 3C shows how the expandable box of embodiments of the disclosed technology expands vertically.

The above will become clearer in view of the description of FIGS. 3A, 3B, and 3C. The rest of the description of FIG. 2 will continue below the description of FIGS. 3A, 3B, and 3C.

FIG. 3A shows how the expandable box of embodiments of the disclosed technology expands simultaneously both horizontally and vertically. Here, the box shown in solid lines is in its smallest configuration with the front panels abutting one other. The front panels end in '40 and are used in some embodiments of the disclosed technology, but can be absent in other embodiments. The panels surround an unobstructed opening into the box in embodiments of the disclosed technology. For purposes of the description of FIGS. 3A, 3B, and 3C, they are used to describe contraction and expansion of the box.

In FIG. 3A, the dotted lines show the box when it is expanded in both the horizontal 1 direction and vertical 2 direction. Horizontal and vertical are interchangeable in embodiments of the disclosed technology (turn the box 90 degrees). For ease of description and understanding, the terminology is described with respect to the orientation of the page on which the drawings are laid out. When the box expands horizontally 1, the front panels 140 and 340 move away horizontally from the front panels 240 and 440. When the box expands vertically 2, the front panels 140 and 240 move away from the front panels 340 and 440. This allows for the structure of the box to be maintained, but the size to increase. For the structure of the box to be maintained, this is defined as having a partial covering on at all but one of the sides and/or having a space between solid material no greater than ⅓ the length of the respective side.

FIG. 3B shows how the expandable box of embodiments of the disclosed technology expands horizontally. Here, the box is expanded only horizontally 1. In this embodiment, the distance between the top and bottom of the box remains constant, such as the distance between the front panels 240 and 140. However, the distance between the piece 100 and 300 with respect to pieces 200 and 400 increases. Said another way, the front panels 140 and 340 move away from the panels 240 and 440 while the other front panels (top and bottom panels) remain at a same distance to one another.

FIG. 3C shows how the expandable box of embodiments of the disclosed technology expands vertically. This is the "opposite" of the expansion shown in FIG. 3B in that the parts which remained constant with respect to one another in FIG. 3B and now increasing in distance to one another and the parts which had an increasing distance from one to another during the expansion are now constant during the expansion. It should be understood that contraction (or making the box/side of the box which is open smaller) can be described in exactly the same way as the above, but in reverse.

Now returning to the description of FIG. 2, as one can now appreciate how the pieces 100, 200, 300, and 400 move with respect to one another, the details of the specific embodiment shown can be described with greater understanding. Referring first to the front panels which were referenced in the description of FIGS. 1, 3A, 3B, and 3C, these front panels have front sides flush with each other (along a same axis of the box, such as the z-axis) regardless of the expansion and contraction of the box. While the front panels can separate from each other (a change in the x and/or y axis) or be adjacent to each other with substantially no, or no space there-between, they remain in a same plane throughout.

Figure 4:
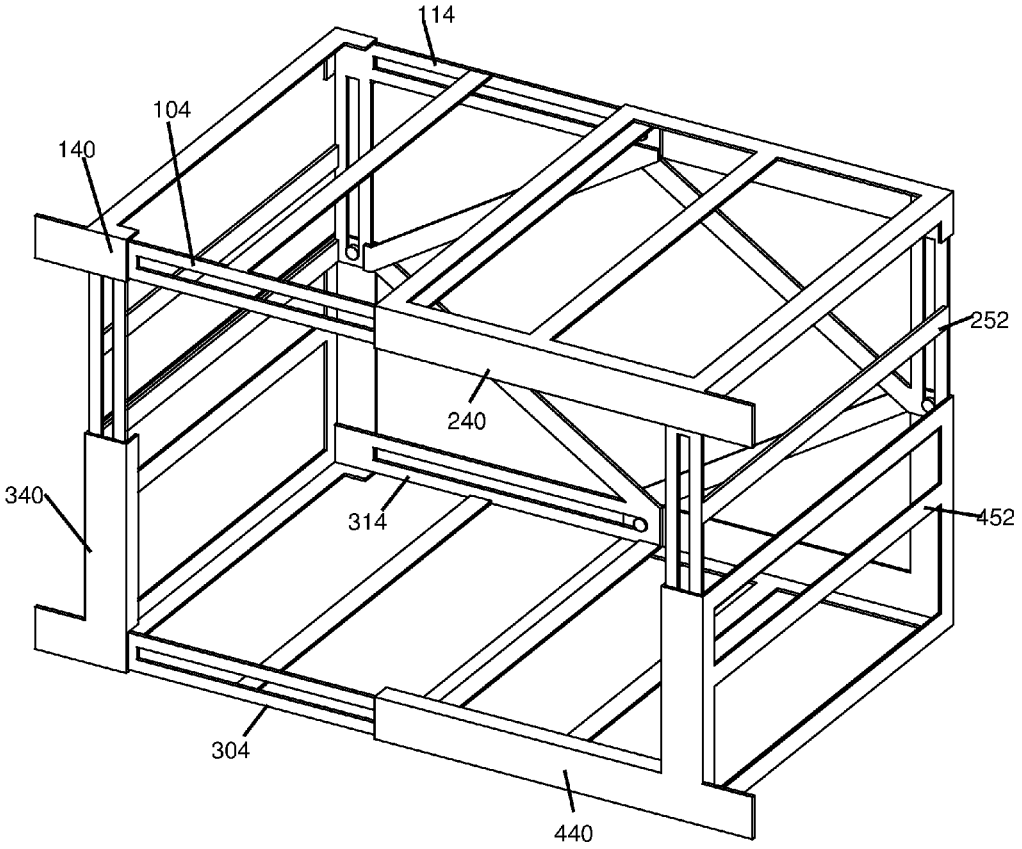
FIG. 4 shows a front perspective view of the expandable box of embodiments of the disclosed technology expanded both horizontally and vertically.
Figure 5:
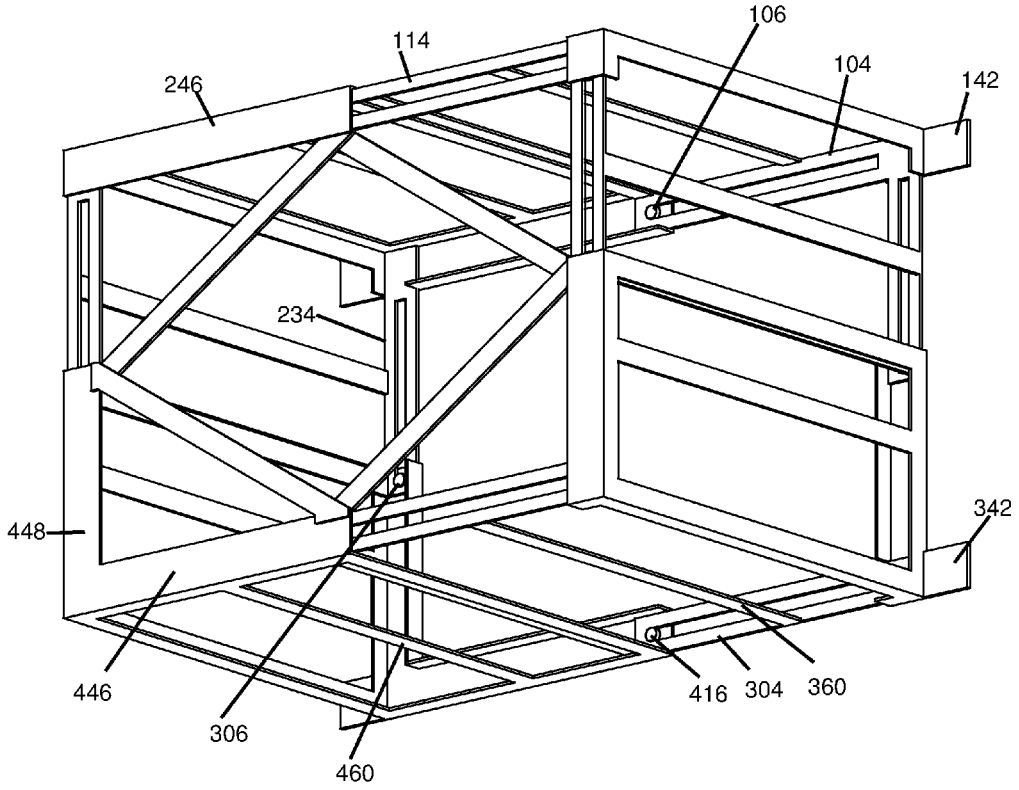
FIG. 5 shows a rear perspective view of the expandable box of embodiments of the disclosed technology expanded both horizontally and vertically.
Figure 6:
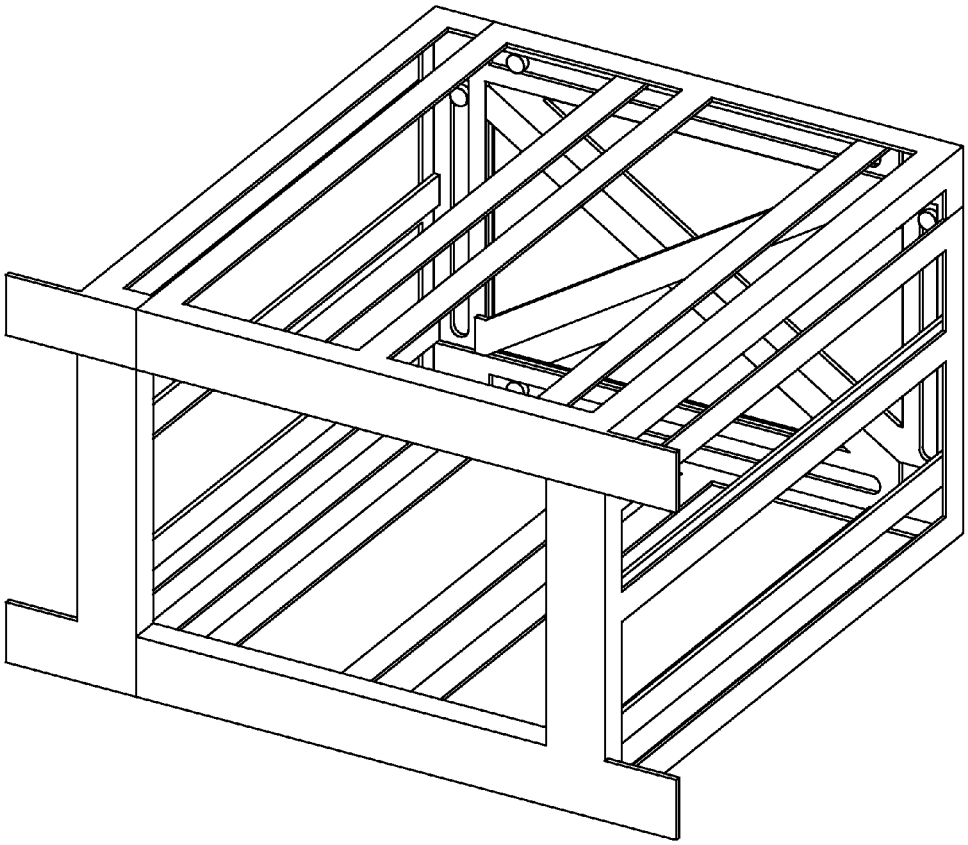
FIG. 6 shows a front perspective view of the expandable box of embodiments of the disclosed technology collapsed both horizontally and vertically.

The above can be seen by comparing FIG. 4 to FIG. 6. FIG. 4 shows a front perspective view of the expandable box of embodiments of the disclosed technology expanded both horizontally and vertically. FIG. 6 shows a front perspective view of the expandable box of embodiments of the disclosed technology collapsed both horizontally and vertically. In FIG. 4, panel 240, a top panel, is separated from panel 140 which is separated from panel 340 which is separated from panel 440 when the box is expanded in both the horizontal and vertical direction. In FIG. 6, in the same order, these panels abut one another or are held closer to one another.

Figure 1:
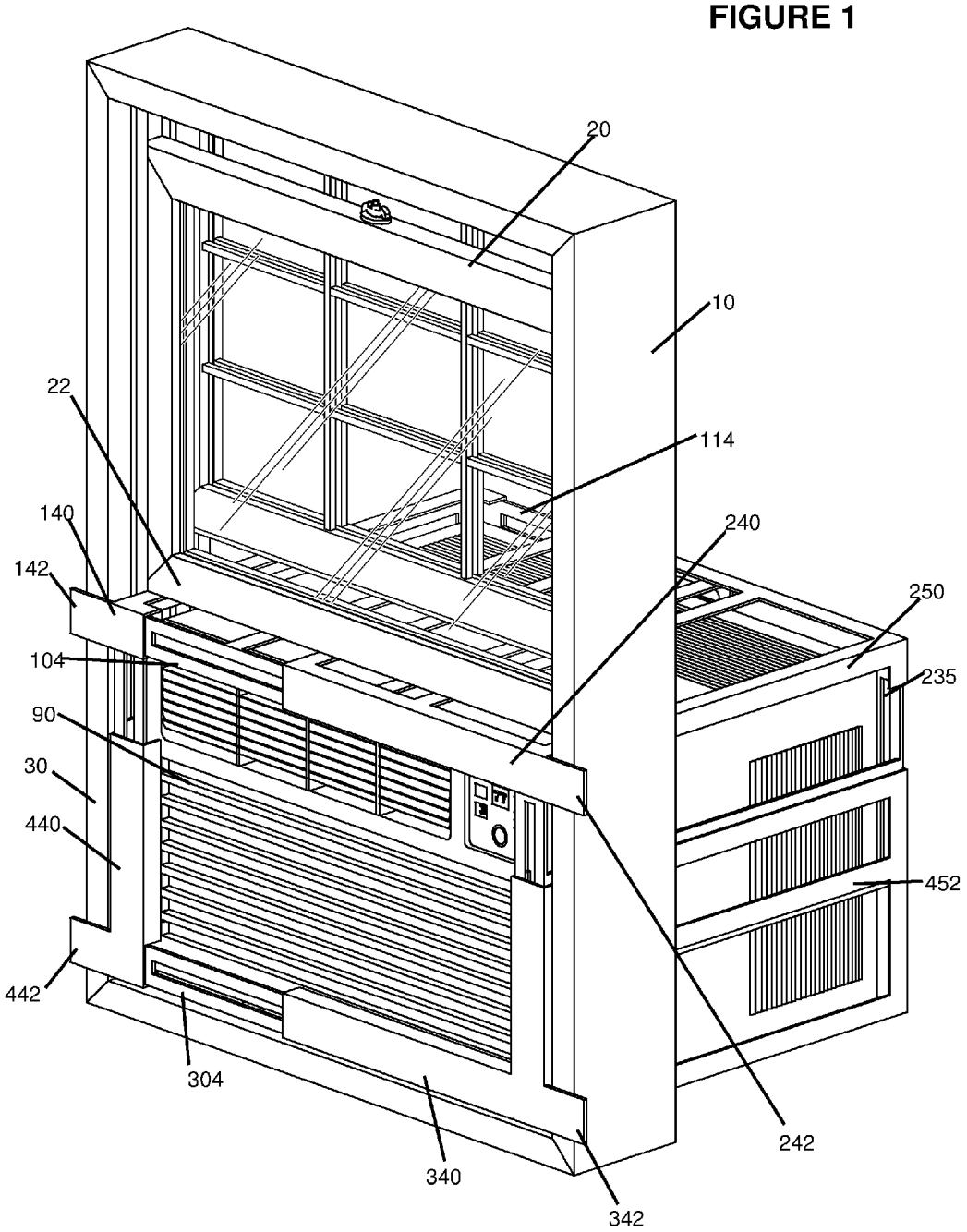
FIG. 1 shows a perspective view of a two-direction expandable box secured to a window in an embodiment of the disclosed technology.

Now jumping to FIG. 1, FIG. 1 shows a perspective view of a two-direction expandable box secured to a window in an embodiment of the disclosed technology. Here, the panels are separated somewhat from one another to fill a space created by an open window and to snugly surround an air conditioner unit 90. This prevents the air conditioner from being stolen or ripped out of the window and prevents unauthorized entry into the window after removing the air conditioner. The window has side walls 10, a front wall 30 (which can be continuous with a larger wall of a dwelling/building) and a sliding portion 20. The sliding portion 20 moves to create an opening in the window between an inside and outside, or between two rooms or the like. The box is then placed, in embodiments of the disclosed technology, such that the sliding portion 20 hits a top/side of the box, such as at a top/side portion 250 and 114. The box is partially interior to the room/wall 30 by way of the front panels, or, at least the front panels. Here, the front panel 140 and 340 extend horizontally across the window and 440 and 240 extend vertically. Portions of the front panels overhang/extend past the opening of the window in the horizontal direction. These portions are given their own numbers 142, 242, 342, and 442.

In order that the box fills or substantially fills the open space created in the window when the movable portion 20 is lifted from a bottom of the window (or to fill another opening in a wall or the like), the box is expanded. Here, one can see some of the rails 104 and 304, for example, as the box is partially expanded in the horizontal direction to be sized to fill the space horizontally. So too, vertically the box has been expanded partially to fill the space in the vertical direction. As such, the box can fill the entirety of a rectangular space. The rectangular space filled by the side walls of the box just behind the front panels (e.g. by side wall 452 and the corresponding side walls of pieces 100, 200, 300, and 400) can be any size rectangular having a length between the smallest and largest horizontal side of the box and a height between the smallest and largest vertical side of the box. Thus, if the box can expand between 1 unit of measure and 10 units of measure both horizontally and vertically, then the space filled by the box could be, for example, 1×10, 10×1, 5×5, 3×7, 7×3, and so forth.

Referring back to FIG. 2 again, note that there are top walls or bars 160, 260, and bottom walls or bars 360 and 460. Any length of material at the top or bottom, for purposes of this disclosure is a top/bottom wall. So too, there are left walls 352, 152, and right walls 352, and 452. Then there are corner walls or "top/side" and "bottom/side" walls 150, 250, 350, and 450. These walls are a single structure/unitary piece used in some embodiments which extend to part of a top/bottom and side. This can be covered with a mesh or complete solid so that the only space into the box is between one or a combination of: a) an opening in one side of the box between pieces 100, 200, 300, and 400 (between the front panels 140, 240, 340, and 440), b) between overlapping adjacent pieces 100, 200, 300, and 400, c) between holes in a mesh cover. Instead of "c", when a mesh cover is not used, this can be replaced with c2) between bars (e.g. bar 260) of the sides and top.

The back side, opposite the opening created between the front panels, can further be closed off by mesh or other walls or wall portions such as the diagonal beams 118, 218, 318, and 418 shown in FIG. 2. A device which fills the space, or substantially fills the space, between the side and top walls (e.g. between 152, 160, 260, 252, 352, 360, 452, and 460) can fit through an opening between the front panels, but is prevented from fitting through an opening at the back side in embodiments of the disclosed technology.

FIG. 5 shows a rear perspective view of the expandable box of embodiments of the disclosed technology expanded both horizontally and vertically. In the back side, some elements hidden from view in the front side are now visible including pins 106 and 416. Note that the diagonal beams 118, 218, 318, and 418 can form a diamond configuration in embodiments. Some of the rails, such as rails 246 and 448 can form a portion of back panels opposite the front panels. Note that back or front panels can have a portion which is vertical and a portion which is horizontal, or simply have a vertical or horizontal section, such as is shown in the figures.

Further discussing FIG. 6, FIG. 6 shows a front perspective view of the expandable box of embodiments of the disclosed technology collapsed both horizontally and vertically. In the collapsed configuration, note that the side walls and top walls overlap each other/have to move past one another to expand the box beyond a certain amount. The diagonal back walls are also overlapping or near each other creating double-thickness walls.

Figure 7:
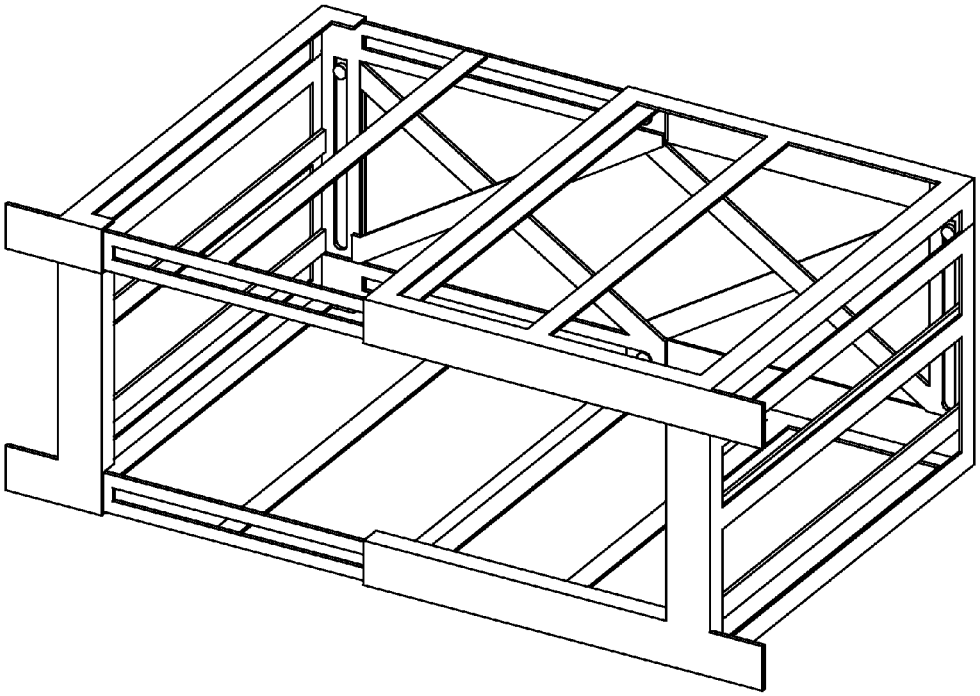
FIG. 7 shows a front perspective view of the expandable box of embodiments of the disclosed technology expanded horizontally and collapsed vertically.
Figure 8:
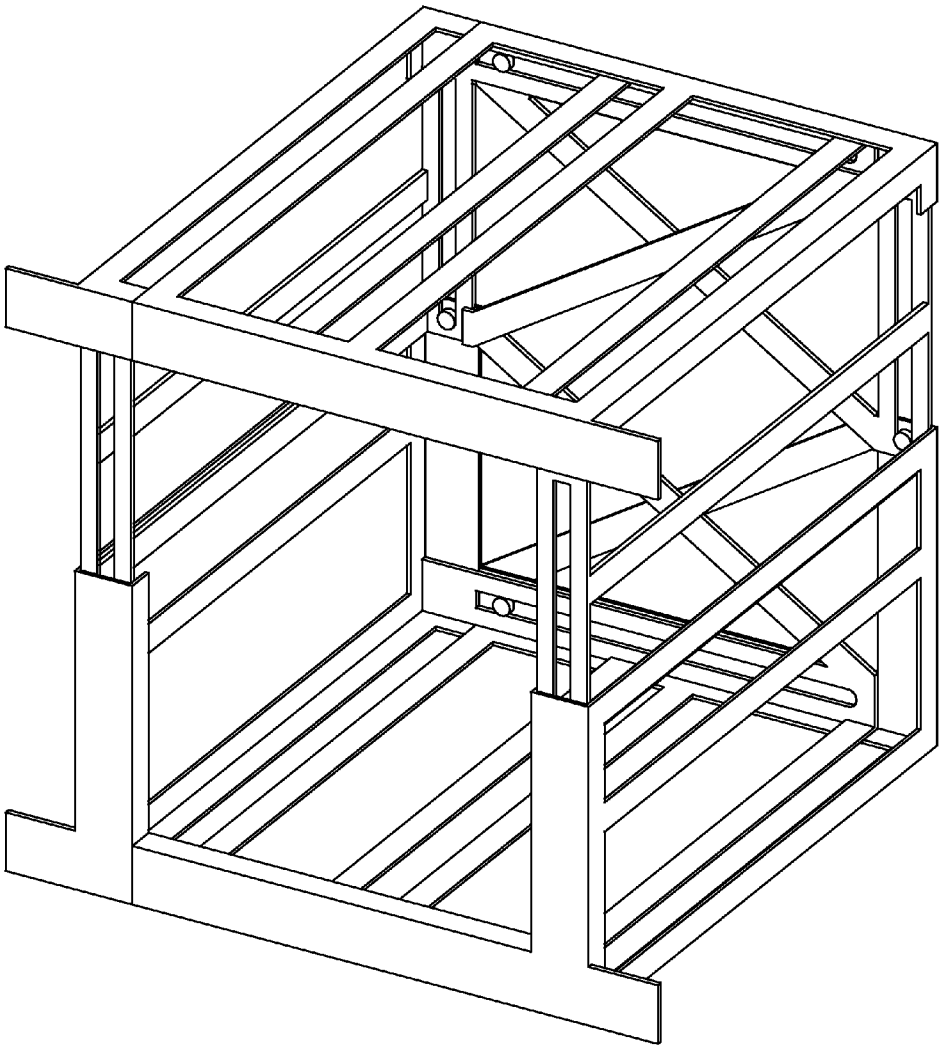
FIG. 8 shows a front perspective view of the expandable box of embodiments of the disclosed technology expanded vertically and collapsed horizontally.

FIG. 7 shows a front perspective view of the expandable box of embodiments of the disclosed technology expanded horizontally and collapsed vertically. FIG. 8 shows a front perspective view of the expandable box of embodiments of the disclosed technology expanded vertically and collapsed horizontally. In the non-expanded direction, there is a double thickness wall, whereas in the expanded direction, is a single-thickness wall. When the box is partially expanded in a direction, compared to it's full ability to collapse or expand, respective walls transverse to such a direction will be partially double and partially single thickness.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described hereinabove are also contemplated and within the scope of the disclosed technology.

The invention claimed is:

1. A box independently expandable in both a horizontal and vertical direction comprising:

four separate pieces, each forming a quadrant of said box;

each of said four separate pieces directly and slidably connected to two others of said four separate pieces in adjacent quadrants;

wherein each of said four separate pieces forms at least a part of two walls of said box which are perpendicular to each other and includes a part forming part of a back side of said box, wherein each said part forming part of a back side of said box includes a diagonal bar, which is diagonal with respect to edges forming a frame of said back side, and which restricts said opening in said back side, and wherein said diagonal bars of said four pieces are slidable along the longitudinal axes of said diagonal bars relative to each other.

2. The box of claim 1, wherein each of said four separate pieces are directly and slidably connected by way of a pin of one of said separate pieces extending through a slot of an adjacent one of said four said separate pieces.

3. The box of claim 2, wherein said box is at least partially closed on five sides and open on a sixth side, said sixth side being surrounded by front panels which extend past each horizontal most extent of at least a left wall and right wall of said box, said left wall comprised of a portion of two of said four separate pieces and said right wall comprised of a portion of two other of said four separate pieces.

4. The box of claim 3, wherein said box is adapted to be positioned within a window such that said front panels are inside the window and a majority of said left wall and said right wall are outside of the window.

5. The box of claim 3, wherein when said box is fully collapsed, said front panels form a rectangular interior space which opens into said box without interruption.

6. The box of claim 5, wherein when said box is expanded, at least partially in said horizontal and said vertical direction, said front panels each become spaced apart from one another and said interior space of said box is increased in two dimensions.

7. The box of claim 1, wherein said four separate pieces comprise a first piece, a second piece, a third piece, and fourth piece such that:

said first piece forms a part of a top side and left side and is directly and slidably connected to said second piece and said third piece;

said second piece forms a part of said top side and right side and is directly and slidably connected to said first piece and said fourth piece;

said third piece forms a part of said left and said a bottom side and is directly and slidably connected to said first piece and said fourth piece; and said fourth piece forms a part of said right side and said bottom side and is directly and slidably connected to said second piece and said third piece.

8. The box of claim 7, wherein said first piece and said fourth piece are without direct connection to one another, and said second piece and said third piece are without direct connection to one other.

9. The box of claim 7, wherein in a collapsed configuration, a side of said top side, left side, right side, and bottom side which is collapsed includes two of said four pieces overlapping each other and thus is of double thickness compared to when expanded.

10. The expandable box of claim 1, wherein said diagonal bars slidingly overlap, such that in a collapsed configuration of said box, said diagonal bars of two of said four pieces cross said diagonal bars of the other two of said four pieces, and in an extended configuration of said box, each of said diagonal bars overlaps and end portions thereof with two other of said diagonal bars, such that said diagonal bars of said four pieces form a diamond shape.

11. An expandable box comprising:

a first side with a first pair of horizontally extending rails and a first pair of vertically extending rails;

a second side opposite said first side with an additional pair of horizontally extending rails and an additional pair of vertically extending rails, wherein each rail of said horizontally extending rails and said vertically extending rails is functionally associated with at least one pin passing through a slot in said rail, such that said at least one pin and said slot are movable relative to one another in one plane to expand or contract said box in said one plane;

a pair of horizontally extending bars, each including one said pin functionally associated with one of said first pair of horizontally extending rails;

a pair of vertically extending bars, each including one said pin functionally associated with one of said first pair of vertically extending rails;

a first diagonal bar extending between a first horizontal rail of said first pair of horizontally extending rails and a first vertical rail of said first pair of vertically extending rails, said first diagonal bar being diagonal with respect to said first horizontal rail and with respect to said first vertical rail;

a second diagonal bar extending between a second horizontal rail of said first pair of horizontally extending rails and a second vertical rail of said first pair of vertically extending rails, said second diagonal bar being diagonal with respect to said second horizontal rail and with respect to said second vertical rail;

a third diagonal bar extending between a first horizontal bar of said pair of horizontally extending bars and a first vertical bar of said pair of vertically extending bars, said third diagonal bar being diagonal with respect to said first horizontal bar and with respect to said first vertical bar; and a fourth diagonal bar extending between a second horizontal bar of said pair of horizontally extending bars and a second vertical bar of said pair of vertically extending bars, said fourth diagonal bar being diagonal with respect to said second horizontal bar and with respect to said second vertical bar, wherein said first, second, third, and fourth diagonal bars are slidable relative to each other.

12. The expandable box of claim 11, wherein said at least one pin is fixed to a side of said box.

13. The expandable box of claim 11, wherein each said pair of rails comprises a first rail and a second rail on an opposite side of said box from each other.

14. The expandable box of claim 11, wherein each rail slides with respect to each pin such that said box is expandable in a first of a vertical or horizontal direction without expanding in a second of said vertical or said horizontal direction.

15. The expandable box of claim 14, wherein each rail slides with respect to each pin such that said box is expandable in both said vertical and said horizontal direction simultaneously.

16. The expandable box of claim 15, wherein said box is sized to fit within an opening of a window.

17. The expandable box of claim 16, wherein said box is adapted to be disposed in a window such that a portion of said box is interior to the window and abutted against the window by front panels which define an opening into said box, said opening being transverse to both said vertical and said horizontal direction.

18. The expandable box of claim 11, further comprising front panels which define an opening into said box, said opening being further defined by said first pair of horizontally extending rails and said first pair of vertically extending rails.

19. The expandable box of claim 18, wherein each other side of said box, other than a side with said opening into said box, is at least partially closed by walls which extend between at least two of said first horizontally extending rails, said additional horizontally extending rails, said first vertically extending rails, and said additional vertically extending rails.

* * * * *